US008931579B2

(12) United States Patent
Bankston et al.

(10) Patent No.: US 8,931,579 B2
(45) Date of Patent: Jan. 13, 2015

(54) BOREHOLE GENERATOR

(75) Inventors: Billy Bankston, Houston, TX (US); Clive Menezes, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2488 days.

(21) Appl. No.: 11/247,737

(22) Filed: Oct. 11, 2005

(65) Prior Publication Data

US 2007/0079989 A1 Apr. 12, 2007

(51) Int. Cl.

| | |
|---|---|
| ***E21B 47/01*** | (2012.01) |
| ***E21B 4/04*** | (2006.01) |
| ***E21B 3/04*** | (2006.01) |
| ***E21B 41/00*** | (2006.01) |

(52) U.S. Cl.

CPC ..... *E21B 41/0085* (2013.01)
USPC ..... 175/40; 175/57; 175/101; 175/195; 175/325.1

(58) Field of Classification Search

None
See application file for complete search history.

(56) References Cited

U.S. PATENT DOCUMENTS

| | | | | |
|---|---|---|---|---|
| 2,998,848 | A | 9/1961 | Wright et al. | |
| 3,788,136 | A * | 1/1974 | Park | 73/152.48 |
| 3,813,656 | A * | 5/1974 | Fowler | 367/82 |
| 3,918,537 | A * | 11/1975 | Heilhecker | 175/320 |
| 3,957,118 | A * | 5/1976 | Barry et al. | 166/385 |
| 4,190,123 | A | 2/1980 | Roddy | |
| 4,747,452 | A | 5/1988 | Clark | |
| 5,033,558 | A | 7/1991 | Russo | |
| 5,269,383 | A | 12/1993 | Forrest | |
| 5,522,467 | A | 6/1996 | Stevens | |
| 5,778,976 | A | 7/1998 | Murray | |
| 6,087,750 | A | 7/2000 | Raad | |
| 6,206,108 | B1 * | 3/2001 | MacDonald et al. | 175/24 |
| 6,397,946 | B1 * | 6/2002 | Vail, III | 166/250.01 |
| 6,581,699 | B1 * | 6/2003 | Chen et al. | 175/61 |
| 7,141,901 | B2 * | 11/2006 | Spring | 310/77 |
| 2001/0052428 | A1 * | 12/2001 | Larronde et al. | 175/61 |
| 2002/0062992 | A1 * | 5/2002 | Fredericks et al. | 175/40 |
| 2004/0124837 | A1 * | 7/2004 | Prammer et al. | 324/303 |
| 2004/0256161 | A1 * | 12/2004 | Aronstam et al. | 175/65 |
| 2005/0056460 | A1 | 3/2005 | Sharp et al. | |
| 2005/0115716 | A1 | 6/2005 | Ciglenec et al. | |

FOREIGN PATENT DOCUMENTS

| | | | |
|---|---|---|---|
| EP | 0681090 A2 | | 11/1995 |
| GB | 2397078 | * | 7/2004 |
| GB | 2411676 | | 9/2005 |
| WO | WO-0036268 A1 | | 6/2000 |
| WO | WO 0111191 A1 | * | 2/2001 |

OTHER PUBLICATIONS

"Australian Patent Application No. 2006228018, Examiner's First Report mailed Mar. 14, 2008", 2 pgs.
"Canadian Patent Application No. 2,563,039, Examiner's Letter mailed Oct. 2, 2008", 3 pgs.

(Continued)

*Primary Examiner* — Zakiya W Bates
(74) *Attorney, Agent, or Firm* — Schwegman Lundberg & Woessner, P.A.; Alan Bryson

(57) ABSTRACT

In some embodiments, apparatus and systems, as well as methods, may operate to couple a stator to a borehole, and to move a rotor relative to the stator to generate electrical current to power a borehole tool.

25 Claims, 4 Drawing Sheets

(56) References Cited

OTHER PUBLICATIONS

"United Kingdom Application No. GB0620153.7, Search Report dated Jan. 16, 2007", 3 pgs.
"Canadian Patent Application No. 2,563,039, Examiner's Letter mailed Oct. 31, 2007", 3 pgs.
"British Application Serial No. 0620153.7, Response filed Feb. 15, 2010 to Examination Report mailed Oct. 28, 2009", 11 pgs.
"British Application Serial No. 0620153.7, Response filed May 6, 2010 to Office Action mailed Mar. 5, 2010", 6 pgs.
"Australian Application Serial No. 2006228018, Response filed Nov. 28, 2008 to Examiner's First Report mailed Mar. 14, 2008", 15 pgs.
"British Application Serial No. 04820747.6, Office Action mailed Mar. 5, 2010", 3 Pgs.
"British Application Serial No. 0620153.7 ; Office Action Response Filed: Oct. 11, 2010", 7 pgs.
"British Application Serial No. 0620153.7, Office Action mailed Jun. 9, 2010", 3 pgs.
"United Kingdom Application Serial No. 0620153.7, Examination Report mailed Oct. 28, 2009", 3 pgs.

* cited by examiner

BOREHOLE GENERATOR

TECHNICAL FIELD

Various embodiments described herein relate to power generation and distribution generally, including apparatus, systems, and methods to generate, store, and supply power in downhole environments.

BACKGROUND INFORMATION

Mud generators and batteries may be used to provide power to electrical equipment located in the downhole environment. However, mud generators, which depend on mud flow to the drill bit for proper operation, can be prone to stalling. Battery power may serve as a backup to a stalled mud generator, but is usually of limited capacity. Therefore, additional sources of downhole power may be desired.

DETAILED DESCRIPTION

In some embodiments, the challenges described above may be addressed by implementing a downhole generator coupled to the borehole and driven by the motion of a rotary table. As long as the rotary table is moving, and the generator (or an attached stabilizer) is coupled to the borehole, power can be provided to downhole electronics. Downhole mud flow may also be less restricted when using this mechanism.

Figure 1:
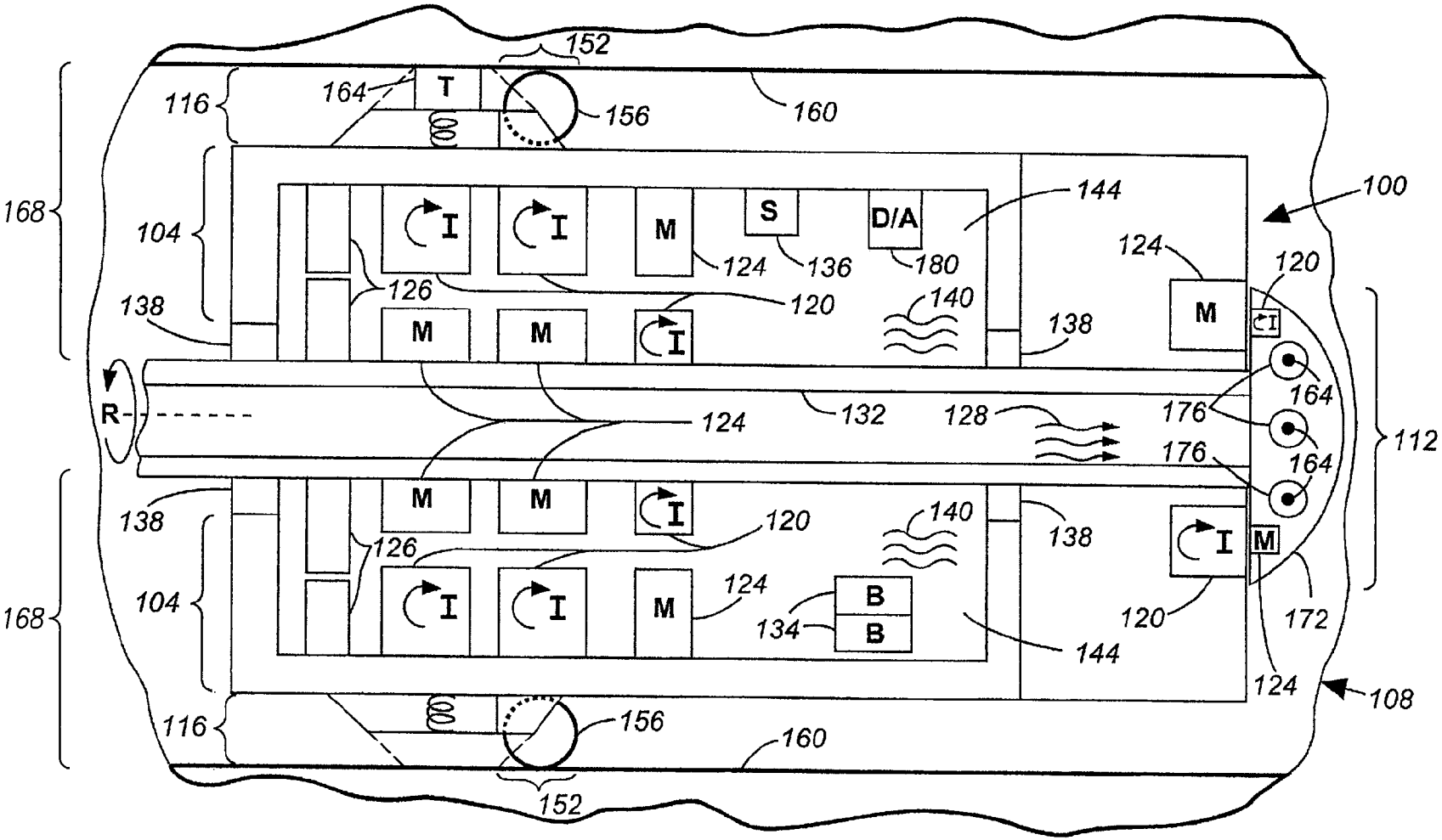
FIG. 1 illustrates an apparatus according to various embodiments of the invention.

FIG. 1 illustrates an apparatus 100 according to various embodiments of the invention. For example, a borehole generator apparatus 100 may include a stator 104 to couple to a borehole 108, and a rotor 112 to generate electrical current I responsive to moving in relation to the stator 104. Thus, the rotor 112 may be coupled to the stator 104 to generate electrical current I, and the rotor 112 may be caused to rotate using power supplied by a rotary table or a mud motor (e.g., elements 210 and 298, respectively, in FIG. 2), or both.

The apparatus 100 may also include a borehole attachment mechanism 116 coupled to the stator 104. For the purposes of this document, "attached," "attachment," "couple," or "coupled" to the borehole means the stator 104 is held in a substantially stationary position in the borehole with respect to the direction of rotation R. The borehole attachment mechanism 116 may be coupled to the stator 104 to assist in coupling the stator 104 to the borehole.

Coils 120 and/or magnets 124 may be included in the stator 104, as well as in the rotor 112. In either case, a current I should be generated when the rotor 112 rotates in relation to the stator 104. Commutation devices 126 (e.g., brushes, slip rings) may be used to route the current I from devices/coils mounted to the stator 104 and rotor 112, and vice versa.

The apparatus 100 may include several alternative or supplemental power supply mechanisms, including one or more batteries 134 to receive the electrical current I, and a switch 136 to receive the electrical current I. The switch 136 may be coupled to a mud generator (see FIG. 2, element 296) so that power provided by the mud generator can be supplied alternately, and in conjunction with the batteries 134 and the apparatus 100.

In some embodiments, a drilling mud 128 passage 132 may be included in the stator 104 and/or (as shown in FIG. 1) the rotor 112. Seals 138, including drilling mud seals, may be applied between the rotor 104 and the stator 112. The seals 138 may perform a variety of functions, such as operating to retain oil 140 within the stator cavity 144, or to keep drilling mud 128 out of the stator cavity 144.

In some embodiments, the borehole attachment mechanism 116 includes a drilling stabilizer device 152 (e.g., a centering dolly), known to those of skill in the art as a device that can be used to center drill string piping or a drilling cleanout tool in a borehole 108. The drilling stabilizer device 152 may be similar to or identical to those devices described in U.S. Pat. Nos. 2,998,848; 4,190,123; 4,747,452; 5,033,558; 5,522,467; and 5,778,976.

Thus, the drilling stabilizer device 152 may include wheels 156 to contact the borehole wall 160. The drilling stabilizer device 152 may include one or more transducers 164, such as ultrasound receivers or acoustic pulsers, to contact the borehole wall 160. The stator 104 and the drilling stabilizer device 152 may be constructed so as to form a substantially integrated assembly.

In some embodiments, the apparatus 100 may be manufactured so that the stator 104 forms a portion of a piggyback stabilizer 168. The piggyback stabilizer 168, known to those of skill in the art, may be similar to or identical to the piggyback stabilizer device shown in U.S. Pat. No. 6,581,699, issued to Chen et al. and assigned to the assignee of the material disclosed herein. The rotor 112 may be included in a drill bit assembly 172. In this case, coils 120 and magnets 124 may be included in the piggyback stabilizer 168 and the drill bit assembly 172. Transducers 164, such as ultrasound transducers, among others, may be included in the drill bit assembly 172. The transducers 164 may be powered by currents I induced in one or more coils 120 included in the rotor 112. The transducers 164 may be mounted in nozzles 176 included in the drill bit assembly 172.

Figure 2:
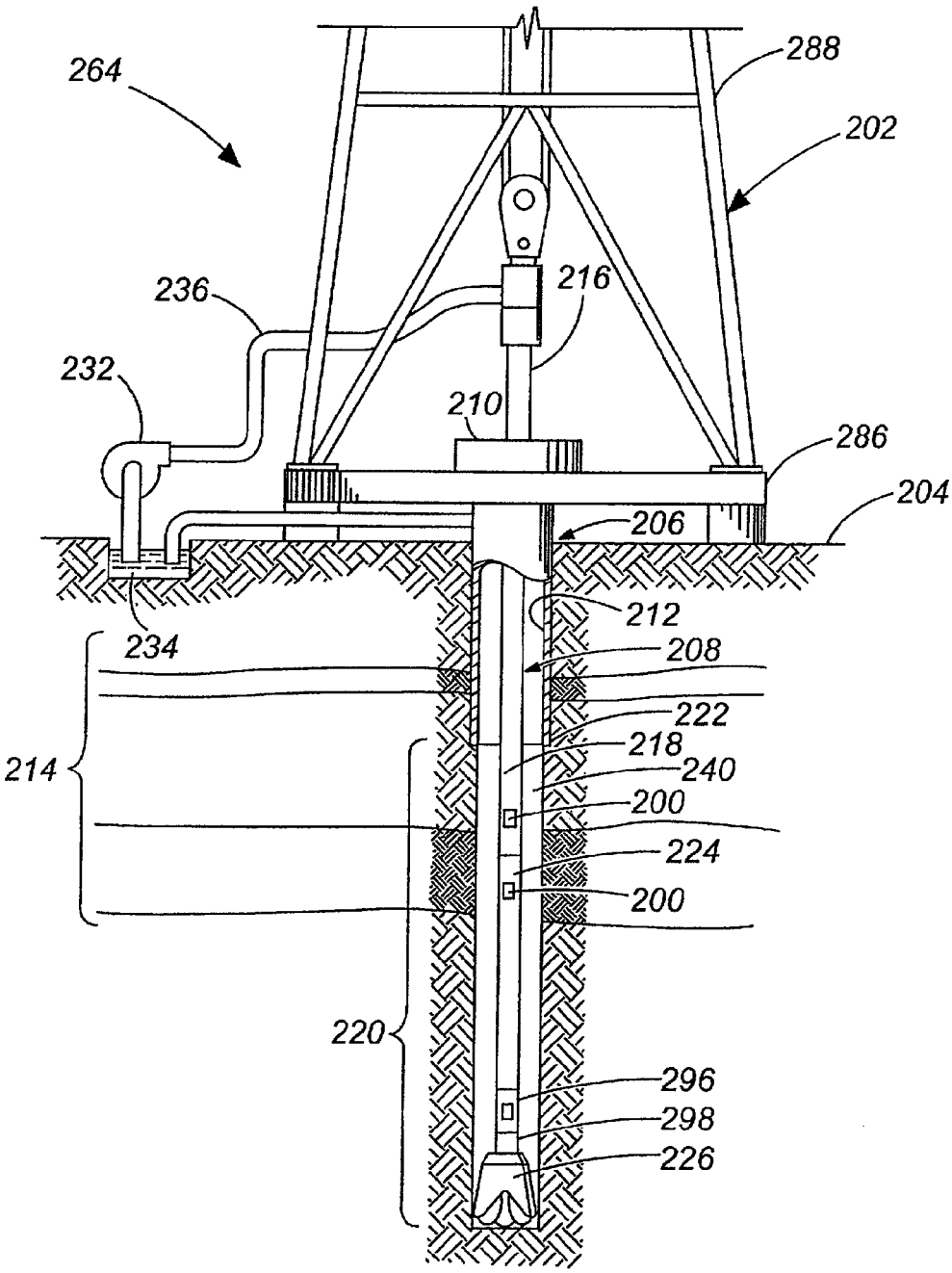
FIG. 2 illustrates apparatus and systems according to various embodiments of the invention.

FIG. 2 illustrates apparatus 200 and systems 264 according to various embodiments of the invention, which may comprise portions of a downhole tool 224 as part of a downhole drilling operation. In some embodiments, a system 264 may also form a portion of a drilling rig 202 located at a surface 204 of a well 206. The drilling rig 202 may provide support for a drill string 208. The drill string 208 may operate to penetrate a rotary table 210 for drilling a borehole 212 through subsurface formations 214. The drill string 208 may include a Kelly 216, drill pipe 218, and a bottom hole assembly 220, perhaps located at the lower portion of the drill pipe 218. The drill string 208 may include wired and unwired drill pipe, as well as wired and unwired coiled tubing.

The bottom hole assembly 220 may include drill collars 222, a downhole tool 224, and a drill bit assembly 226. The drill bit assembly 226 may operate to create a borehole 212 by penetrating the surface 204 and subsurface formations 214. The downhole tool 224 may comprise any of a number of different types of tools including MWD (measurement while drilling) tools, LWD (logging while drilling) tools, and others.

During drilling operations, the drill string 208 (perhaps including the Kelly 216, the drill pipe 218, and the bottom hole assembly 220) may be rotated by the rotary table 210. In addition to, or alternatively, the bottom hole assembly 220 may also be rotated by a motor (e.g., a mud motor) that is located downhole. The drill collars 222 may be used to add weight to the drill bit 226. The drill collars 222 also may stiffen the bottom hole assembly 220 to allow the bottom hole assembly 220 to transfer the added weight to the drill bit assembly 226, and in turn, assist the drill bit assembly 226 in penetrating the surface 204 and subsurface formations 214.

During drilling operations, a mud pump 232 may pump drilling fluid (sometimes known by those of skill in the art as "drilling mud") from a mud pit 234 through a hose 236 into the drill pipe 218 and down to the drill bit assembly 226. The drilling fluid can flow out from the drill bit assembly 226 and be returned to the surface 204 through an annular area 240 between the drill pipe 218 and the sides of the borehole 212. The drilling fluid may then be returned to the mud pit 234, where such fluid is filtered. In some embodiments, the drilling fluid can be used to cool the drill bit assembly 226, as well as to provide lubrication for the drill bit assembly 226 during drilling operations. Additionally, the drilling fluid may be used to remove subsurface formation 214 cuttings created by operating the drill bit assembly 226.

Thus, referring now to FIGS. 1 and 2, it may be seen that in some embodiments, the system 264 may include a drill collar 222 and a downhole tool 224, to which one or more apparatus 200, similar to or identical to the apparatus 100 described above and illustrated in FIG. 1, are attached. The downhole tool 224 may comprise an LWD tool or MWD tool, and may form part of a bottom hole assembly 220, as mentioned above.

Thus, in some embodiments, a system 264 may include a drilling rig rotary table 210, and an apparatus 200, identical or similar to the apparatus 100 describe above. That is, the system 264 may include a stator 104 to attach to the borehole 212, a rotor 112 to couple to the drilling rig rotary table 210 and to generate electrical current I responsive to moving in relation to the stator 104. The system 264 may include a borehole attachment mechanism 116 coupled to the stator 104. As noted above, in some embodiments, a mud motor 298 may be coupled to the rotor 112 to generate electrical current I responsive to moving in relation to the stator 104. Thus, the rotor 112 may be caused to rotate using power supplied by a rotary table 210 or a mud motor 298, or both.

In some embodiments, the electrical current I may be transmitted to the bottom hole assembly 220, and the bottom hole assembly 220 may include a plurality of transducers 164, such as downhole sensors, and acoustic receivers and/or pulsers. The system 264 may also include a data acquisition system 180 coupled to the downhole sensors. The data acquisition system 180 may include one or more processors, including digital signal processors, to acquire data such as nuclear, mud resistivity, acoustic, and magnetic resonance imagery data. The system 264 may also include a switch 136 to receive the electric current I, and a mud generator 296 coupled to the switch 136.

The apparatus 100, 200; stator 104; boreholes 108, 212; rotor 112; borehole attachment mechanism 116; coils 120; magnets 124; commutation devices 126; drilling mud 128; passage 132; batteries 134; switch 136; seals 138; oil 140; stator cavity 144; drilling stabilizer device 152; wheels 156; borehole wall 160; transducers 164; piggyback stabilizer 168; drill bit assemblies 172, 226; data acquisition system 180; drilling rig 202; surface 204; well 206; drill string 208; rotary table 210; formations 214; Kelly 216; drill pipe 218; bottom hole assembly 220; drill collars 222; downhole tool 224; drill bit 226; mud pump 232; mud pit 234; hose 236; annular area 240; systems 264; drilling platform 286; derrick 288; mud generator 296; mud motor 298; and electrical current I may all be characterized as "modules" herein. Such modules may include hardware circuitry, and/or a processor and/or memory circuits, software program modules and objects, and/or firmware, and combinations thereof, as desired by the architect of the apparatus 100, 200 and systems 264, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for drilling and logging operations, and thus, various embodiments are not to be so limited. The illustrations of apparatus 100, 200 and systems 264 are intended to provide a general understanding of the structure of various embodiments, and they are not intended to serve as a complete description of all the elements and features of apparatus and systems that might make use of the structures described herein.

Applications that employ the novel apparatus and systems of various embodiments include a variety of electronic systems, such as computers, workstations, vehicles, and data acquisition, among others. Some embodiments include a number of methods.

Figure 3:
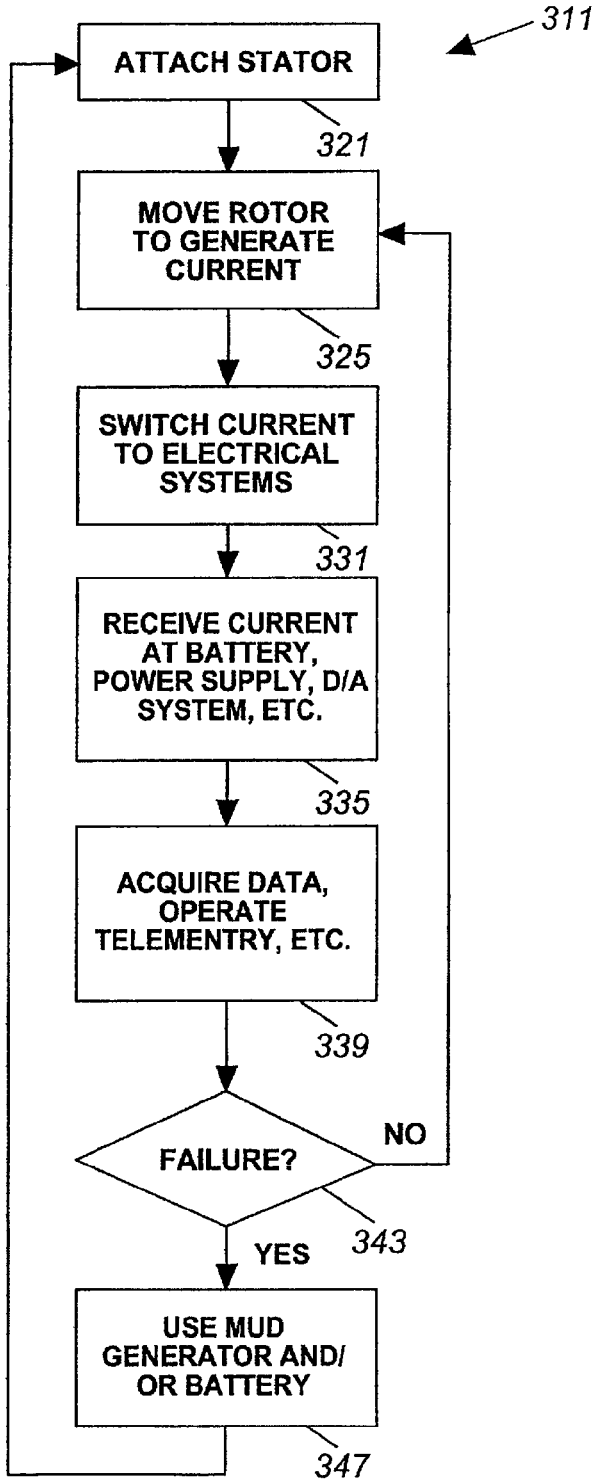
FIG. 3 illustrates a method flow diagram according to various embodiments of the invention.

For example, FIG. 3 illustrates a method flow diagram 311 according to various embodiments of the invention. In some embodiments of the invention, a method 311 may (optionally) begin at block 321 with coupling a stator to a borehole. The method 311 may continue at block 325 with moving a rotor relative to the stator to generate electrical current to power a borehole tool, such as the downhole tool 224 shown in FIG. 2. The power to move or rotate the rotor may be supplied by a rotary table, a mud motor, or both.

In some embodiments, the method 311 may include, at block 331 switching the electrical current so as to be received by (and to provide power to) a plurality of electrical systems, such as a data acquisition system, batteries, transducers, including sonic receivers and pulsers, and magnetic resonance imaging systems. Thus, the method 311 may include receiving the electrical current at a power supply coupled to a data acquisition system, and/or receiving the electrical current at a battery to charge the battery at block 335. In some embodiments, the method 311 may include the operation of the various electrical systems at block 339, such as acquiring geological formation data using the data acquisition system and/or operating a mud pulse telemetry system powered by the electrical current.

The method 311 may also include sensing a failure to supply the electrical current to one or more electrical systems, such as a data acquisition system, at block 343. If no failure is detected, then the method 311 may continue with moving the rotor and generating current at block 325. If a failure to supply electrical current is sensed at block 343, then the method 311 may include using a mud generator and/or batteries to supply power to the electrical systems that are not receiving the current, such as a data acquisition system or mud pulse telemetry system. In some embodiments, use of the mud generator may be preferred over using batteries (e.g., due to the limited capacity of some batteries), such that a change to using the mud generator is almost always made when the rotary table stops turning, rather than switching to battery power.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received, and perhaps stored using a variety of media, tangible and intangible, including one or more carrier waves.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand that various programming languages may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well known to those skilled in the art, such as application program interfaces or interprocess communication techniques, including remote procedure calls. The teachings of various embodiments are not limited to any particular programming language or environment. Thus, other embodiments may be realized.

Figure 4:
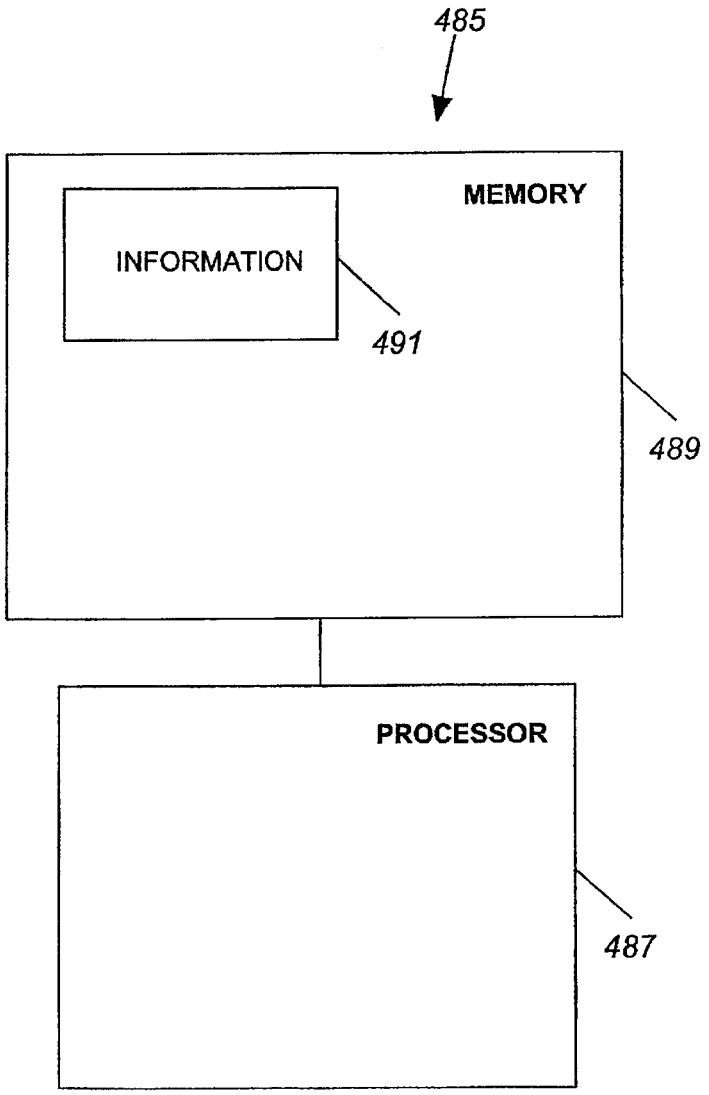
FIG. 4 is a block diagram of an article according to various embodiments of the invention.

Thus, other embodiments may be realized. For example, FIG. 4 is a block diagram of an article 485 according to various embodiments, such as a computer, a memory system, a magnetic or optical disk, some other storage device, and/or any type of electronic device or system. The article 485 may include a computer 487 (having one or more processors) coupled to a computer-readable medium 489, such as a memory (e.g., fixed and removable storage media, including tangible memory having electrical, optical, or electromagnetic conductors) or a carrier wave, having associated information 491 (e.g., computer program instructions and/or data), which when executed by the computer 487, causes the computer 487 to perform a method including such actions as coupling a stator to a borehole, and moving a rotor relative to the stator to generate electrical current to power a borehole tool.

Further actions may include, for example, switching the electrical current so as to be received by a plurality of electrical systems, including data acquisition systems, batteries, transducers (e.g., pulsers and receivers), and magnetic resonance imaging systems. Thus, the actions may include switching the electrical current to power a data acquisition system and acquiring geological formation data using the data acquisition system. Other actions may include sensing a failure to supply the electrical current to the data acquisition system and using a mud generator or a battery to supply power to the data acquisition system. Additional actions may include any of those forming a portion of the methods illustrated in FIG. 3 and described above.

Implementing the apparatus, systems, and methods of various embodiments may enable the provision of power to downhole electronics on a more regular basis. The borehole generator apparatus described herein may act as a primary or auxiliary source of power downhole. Compared to the conditions experienced when a mud generator is used to supply power, the use of this apparatus may also result in a less restricted mud flow during drilling operations.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a stator arranged to operatively couple to a borehole;

a rotor electromagnetically coupled to the stator to generate electrical current, the rotor to rotate using power;

a switch arranged to receive the electrical current and to provide power to one or more electrical systems disposed in the borehole; and a mud generator coupled to the switch such that the mud generator operatively provides the power to the one or more electrical systems.

2. The apparatus of claim 1, wherein said rotor to rotate using power comprises using power supplied by at least one of a rotary table and a mud motor.

3. The apparatus of claim 1, wherein a coil is included in the rotor, and wherein a magnet is included in the stator.

4. The apparatus of claim 1, further including:

a drilling mud passage in one of the stator or the rotor.

5. The apparatus of claim 1, further including:

a battery to receive the electrical current.

6. The apparatus of claim 1, further including a borehole attachment mechanism having a drilling stabilizer device.

7. The apparatus of claim 6, wherein the drilling stabilizer device includes wheels to contact a wall of the borehole.

8. The apparatus of claim 6, wherein the drilling stabilizer device includes a sensor to contact a wall of the borehole.

9. The apparatus of claim 6, wherein the stator and the drilling stabilizer device form a substantially integrated assembly.

10. The apparatus of claim 1, further including:

a drilling mud seal between the rotor and the stator.

11. The apparatus of claim 1, wherein the stator is included in a piggy-back stabilizer, and wherein the rotor is included in a drill bit assembly.

12. The apparatus of claim 11, further including:

a sensor included in the drill bit assembly.

13. The apparatus of claim 11, further including:

a coil included in the rotor, the coil to receive an induced current to power a sensor included in the drill bit assembly.

14. An apparatus, comprising:

a stator arranged to operatively couple to a borehole;

a rotor electromagnetically coupled to the stator to generate electrical current, the rotor to rotate using power; and a switch coupled to a mud generator and arranged to receive the electrical current, the switch to provide power to one or more electrical systems disposed in the borehole, wherein a coil is included in the stator, and wherein a magnet is included in the rotor.

15. An apparatus, comprising:

a stator arranged to operatively couple to a borehole;

a rotor electromagnetically coupled to the stator to generate electrical current, the rotor to rotate using power; and a switch coupled to a mud generator and arranged to receive the electrical current, the switch to provide power to one or more electrical systems disposed in the borehole, wherein a first coil and a first magnet are included in the rotor, and wherein a second coil and a second magnet are included in the stator.

16. A system, comprising:

a drilling rig rotary table;

a stator arranged to operatively couple to a borehole;

a rotor electromagnetically coupled to the stator to generate electrical current, said rotor to rotate using power supplied by the drilling rig rotary table;

a switch arranged to receive the electrical current and to provide power to one or more electrical units disposed in the borehole; and a mud generator coupled to the switch such that the mud generator operatively provides the power to the one or more electrical systems.

17. The system of claim 16, wherein the electrical current is to be transmitted to a bottom hole assembly.

18. The system of claim 17, wherein the bottom hole assembly further includes:

a plurality of downhole sensors; and a data acquisition system coupled to the plurality of downhole sensors.

19. A system, comprising:

a drilling rig rotary table;

a stator arranged to operatively couple to a borehole;

a rotor electromagnetically coupled to the stator to generate electrical current, said rotor to rotate using power supplied by the drilling rig rotary table; and a switch coupled to a mud generator and to the electrical current, the switch to transmit power to a bottom hole assembly, wherein the bottom hole assembly includes a plurality of acoustic pulsers.

20. A method, comprising:

coupling a stator to a borehole;

moving a rotor relative to the stator to generate electrical current to power a borehole tool; and switching between the electrical current and a mud generator so as to provide power one or more electrical systems of the borehole tool.

21. The method of claim 20, further including:

receiving the electrical current at a power supply coupled to a data acquisition system.

22. The method of claim 20, further including:

receiving the electrical current at a battery to charge the battery.

23. The method of claim 20, further including:

sensing a failure to supply the electrical current to a data acquisition system; and using a battery to supply power to the data acquisition system.

24. A method, comprising:

coupling a stator to a borehole;

moving a rotor relative to the stator to generate electrical current to power a borehole tool;

sensing a failure to supply the electrical current to a data acquisition system; and using a mud generator to supply power to the data acquisition system alternatively from supplying the electrical current to the data acquisition system.

25. A method, comprising:

coupling a stator to a borehole;

moving a rotor relative to the stator to generate electrical current to power a borehole tool; and operating a mud pulse telemetry system powered from a switch coupled to the electrical current and a mud generator.

* * * * *